US007275471B2

(12) United States Patent
Nishri et al.

(10) Patent No.: US 7,275,471 B2
(45) Date of Patent: Oct. 2, 2007

(54) MIXED WIRE BRAIDED DEVICE WITH STRUCTURAL INTEGRITY

(75) Inventors: Boaz Nishri, Maagan Michael (IL); Avraham Rapaport, Tel Aviv (IL); Gilad Cibulski, Moshav Herat (IL); Yaniv Fouks, Rishon LeZion (IL)

(73) Assignee: Surpass Medical Ltd., Tel-Aviv (IL)

( * ) Notice: Subject to any disclaimer, the term of this patent is extended or adjusted under 35 U.S.C. 154(b) by 0 days.

(21) Appl. No.: 11/022,872

(22) Filed: Dec. 28, 2004

(65) Prior Publication Data

US 2005/0257674 A1 Nov. 24, 2005

Related U.S. Application Data

(60) Provisional application No. 60/532,571, filed on Dec. 29, 2003.

(51) Int. Cl.
*D04C 1/02* (2006.01)

(52) U.S. Cl. ..... 87/8; 87/13

(58) Field of Classification Search ..... 87/5, 87/8, 9, 11, 13

See application file for complete search history.

(56) References Cited

U.S. PATENT DOCUMENTS

| | | | | |
|---|---|---|---|---|
| 4,158,984 | A * | 6/1979 | Griffiths | 87/8 |
| 4,754,685 | A * | 7/1988 | Kite et al. | 87/9 |
| 6,250,193 | B1 * | 6/2001 | Head | 87/2 |
| 2002/0066360 | A1 * | 6/2002 | Greenhalgh et al. | 87/8 |

* cited by examiner

*Primary Examiner*—Shaun R. Hurley

(57) ABSTRACT

A braided device comprising: filaments of a first type and of a second type, the second type differing from the first type in at least one characteristic; the first type of filaments defining an integral symmetrical 1×1 sub-pattern; and the combination of the first type of filaments and the second type of filaments being braided together into a braided device exhibiting a uniform braid pattern.

16 Claims, 10 Drawing Sheets

| Hom Gear Number | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| Carrier Direction → | $F_1$ | | $F_2$ | | $F_2$ | | $F_2$ | | $F_2$ | | $F_2$ | | $F_2$ | | $F_2$ | | $F_2$ | | $F_1$ | | $F_2$ | | $F_2$ | | $F_2$ | | $F_2$ | | $F_2$ | | $F_2$ | | $F_2$ | | $F_2$ | |
| Carrier Direction ← | | $F_2$ | | $F_2$ | | $F_2$ | | $F_2$ | | $F_1$ | | $F_2$ | | $F_2$ | | $F_2$ | | $F_2$ | | $F_2$ | | $F_2$ | | $F_2$ | | $F_2$ | | $F_1$ | | $F_2$ | | $F_2$ | | $F_2$ | | $F_2$ |

| Hom Gear Number | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| Carrier Direction → | $F_1$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_1$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ |
| Carrier Direction ← | $F_2$ | $F_2$ | $F_2$ | $F_2$ | $F_2$ | $F_2$ | $F_2$ | $F_2$ | $F_2$ | $F_1$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_2$ | $F_1$ | $F_2$ | $F_2$ | $F_2$ | $F_2$ | $F_2$ | $F_2$ | $F_2$ | $F_2$ |

Fig. 16b

| Hom Gear Number | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| Carrier Direction → | $F_1$ | | $F_2$ | | $F_2$ | | $F_2$ | | $F_2$ | | $F_2$ | | $F_2$ | | $F_2$ | | $F_2$ | | $F_1$ | | $F_2$ | | $F_2$ | | $F_2$ | | $F_2$ | | $F_2$ | | $F_2$ | | $F_2$ | | $F_2$ | |
| Carrier Direction → | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | |
| Carrier Direction ← | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | $F_2$ | | |
| Carrier Direction ← | | $F_2$ | | $F_2$ | | $F_2$ | | $F_2$ | | $F_1$ | | $F_2$ | | $F_2$ | | $F_2$ | | $F_2$ | | $F_2$ | | $F_2$ | | $F_2$ | | $F_2$ | | $F_1$ | | $F_2$ | | $F_2$ | | $F_2$ | | $F_2$ |

Fig. 16c

| Hom Gear Number | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| Carrier Direction → | $F_1$ | $F_3$ | $F_3$ | $F_2$ | $F_3$ | $F_3$ | $F_3$ | $F_3$ | $F_3$ | $F_2$ | $F_3$ | $F_3$ | $F_3$ | $F_3$ | $F_3$ | $F_2$ | $F_3$ | $F_3$ | $F_1$ | $F_3$ | $F_3$ | $F_2$ | $F_3$ | $F_3$ | $F_3$ | $F_3$ | $F_3$ | $F_2$ | $F_3$ | $F_3$ | $F_3$ | $F_3$ | $F_3$ | $F_2$ | $F_3$ | $F_3$ |
| Carrier Direction ← | $F_2$ | $F_3$ | $F_3$ | $F_3$ | $F_3$ | $F_3$ | $F_2$ | $F_3$ | $F_3$ | $F_1$ | $F_3$ | $F_3$ | $F_2$ | $F_3$ | $F_3$ | $F_3$ | $F_3$ | $F_3$ | $F_2$ | $F_3$ | $F_3$ | $F_3$ | $F_3$ | $F_3$ | $F_2$ | $F_3$ | $F_3$ | $F_1$ | $F_3$ | $F_3$ | $F_2$ | $F_3$ | $F_3$ | $F_3$ | $F_3$ | $F_3$ |

Fig. 16d

MIXED WIRE BRAIDED DEVICE WITH STRUCTURAL INTEGRITY

CROSS-REFERENCE TO RELATED APPLICATIONS

This application claims priority from U.S. Provisional Patent Application Ser. No. 60/532,571 file Dec. 29, 2003 entitled "Mixed Wire Braided Device with Structural Integrity" the entire contents of which are incorporated herein by reference.

BACKGROUND OF THE INVENTION

The invention relates generally to the field of braided devices and more particularly to a braided devices having multiple filament types.

Braiding is used in a wide variety of different fields, for example, textiles, electronics, aerospace, and medicine, for performing a variety of different applications, for example, harnessing, shielding, and/or reinforcing, materials and structures, requiring special or high performance properties, characteristics, and behavior. In medicine, braiding is used to produce, among others, implantable intraluminal devices, including stents, stent-grafts, preventing devices and stroke preventing devices. Stents are used to support diseased or damaged arteries and body lumens, an example of which is disclosed in U.S. Pat. No. 4,655,771 issued to Wallsten whose contents are incorporated herein by reference, while stent-grafts have the added task of covering or bridging leaks or dissections. A stroke preventing device, also known as a diverter, is described in U.S. Pat. No. 6,348,063 issued to Yodfat et al., copending U.S. patent application Ser. No. 09/637,287 filed Aug. 11, 2000 entitled "Implantable Stroke Treating Device", and co-pending U.S. Patent Application 10/311,876 filed Jul. 9, 2001 entitled "Implantable Braided Stroke Preventing Device and Method of Manufacturing" the entire contents of which are incorporated herein by reference.

Stroke preventing devices such as diverters, are typically produced from filaments comprising a finer wire than is found in a stent, as its task is primarily to filter, or block the flow of emboli, and not to support diseased or damaged arteries and body lumens. Unfortunately, in certain circumstances, filaments that are advantageous for use as a filter are insufficient to supply sufficient overall structural strength for the device. In other cases, fine wire filaments used in the device are not readily visualized under standard fluoroscopic equipment, thus rendering precise placement and follow up of patients difficult.

The term filament as used herein is to be understood to include strands, round wires, non-round wires, monofilaments, slit tape, multifilament yarn, braids or other longitudinal product.

In order for the implantable intraluminal device to be radiopaque, it must be made from a material possessing radiographic density higher than the surrounding host tissue, while having sufficient thickness to affect the transmission of x-rays and thus produce contrast in the image. A braided device, utilizing a biocompatible fine wire such as stainless steel or cobalt based alloys of a diameter less than 100 μm, such as a stroke preventing device described in pending U.S. patent application Ser. No. 10/311,876 filed Jul. 9, 2001 entitled "Implantable Braided Stroke Preventing Device and Method of Manufacturing", whose contents are incorporated herein by reference is not normally radiopaque.

U.S. Pat. No. 5,718,159 issued to Thompson, incorporated herein by reference, discloses a process for making a prosthesis for intraluminal implantation, the prosthesis having a flexible tubular three dimensional braided structure of metal or polymeric monofilaments, and polymeric multifilament yarns. The monofilaments are selectively shaped before their interbraiding with the multifilament yarns, and the textile strands are braided in one or more layers of sheeting that reduce permeability. The use of a three dimensional braided structure, comprising pre-shaping of the monofilaments, adds extra complexity to the manufacturing process, with a resultant increase in cost.

The term two dimensional braided structure as used herein defines a braided structure comprising a single braid layer. The term three dimensional braided structure as used herein defines a braided structure comprising a plurality of braid layers.

Thus there is a need for a braided device comprising multiple filament types having improved structural stability. There is a further need for a method of braiding a braided device comprising multiple filament types, having improved overall structural stability.

SUMMARY OF THE INVENTION

Accordingly, it is a principal object of the present invention to overcome the disadvantages of prior art braided devices and methods. This is provided in the present invention by providing a braided device comprising multiple filament types, in which at least one of the filament types define an independent stable structure of a symmetrical 1×1 sub-pattern, the multiple filament types being braided together into a single braided device exhibiting a uniform overall braid pattern.

The invention provides for a braided device comprising: filaments of a first type and of a second type, the second type differing from the first type in at least one characteristic; the first type of filaments defining an integral symmetrical 1×1 sub-pattern; and the combination of the first type of filaments and the second type of filaments being braided together into a braided device exhibiting a uniform braid pattern.

In one preferred embodiment, the characteristic of the braided device is rigidity, the first type of filaments being more rigid than said second type of filaments. In another preferred embodiment, the integral symmetric 1×1 sub-pattern provides 75% of the rigidity of said braided device. Further preferably, the integral symmetric 1×1 sub-pattern provides 90% of the rigidity of said braided device.

In another preferred embodiment, the braided device is an implantable intraluminal device. In another preferred embodiment, the braided device is a stent-graft, and in yet another preferred embodiment, the braided device is a filter.

In one embodiment the braid pattern is a single filament 1×1 braid pattern, in another embodiment the said braid pattern is a double filament 1×1 braid pattern, and in yet another embodiment the braid pattern is a 1×2 braid pattern.

The invention also provides for a method for braiding comprising: selecting a braiding apparatus having a number of horn gears, the number of horn gears being designated N; selecting a first filament type and a second filament type, the second filament type being different from the first filament type in at least one characteristic; and loading the first filament type on carriers on the horn gears, such that the number of horn gears being loaded, designated M, satisfy the equation N/M=odd integer, and M is an even integer, the horn gears being loaded symmetrically and evenly; loading the second filament type on all unoccupied carriers on said horn gears; and operating the braiding apparatus to produce a braided device having a braid pattern; whereby the first filament type define an integral symmetrical 1×1 sub-pattern.

In one preferred embodiment, the characteristic is rigidity, the first type of filaments being more rigid than the second type of filaments. In another embodiment the integral symmetric 1×1 sub-pattern provides 75% of the rigidity of the braided device. Further preferably the integral symmetric 1×1 sub-pattern provides 90% of the rigidity of the braided device.

In one preferred embodiment the braided device is an implantable intraluminal device, in another preferred embodiment, the braided device is a stent, and in yet another preferred embodiment the braided device is a stroke prevention device.

In one preferred embodiment the braid pattern is a single filament 1×1 braid pattern, in another preferred embodiment the braid pattern is a double filament 1×1 braid pattern, and in yet another preferred embodiment the braid pattern is a 1×2 braid pattern.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings:

FIG. 14 illustrates a high level side view of a braided device in accordance with the principle of the current invention;

FIG. 16*a*–FIG. 16*d* illustrate high level schematic views of the loading of a Maypole type braiding apparatus comprising 36 horn gears in accordance with the principle of the current invention.

DETAILED DESCRIPTION OF THE PREFERRED EMBODIMENTS

Figure 1:
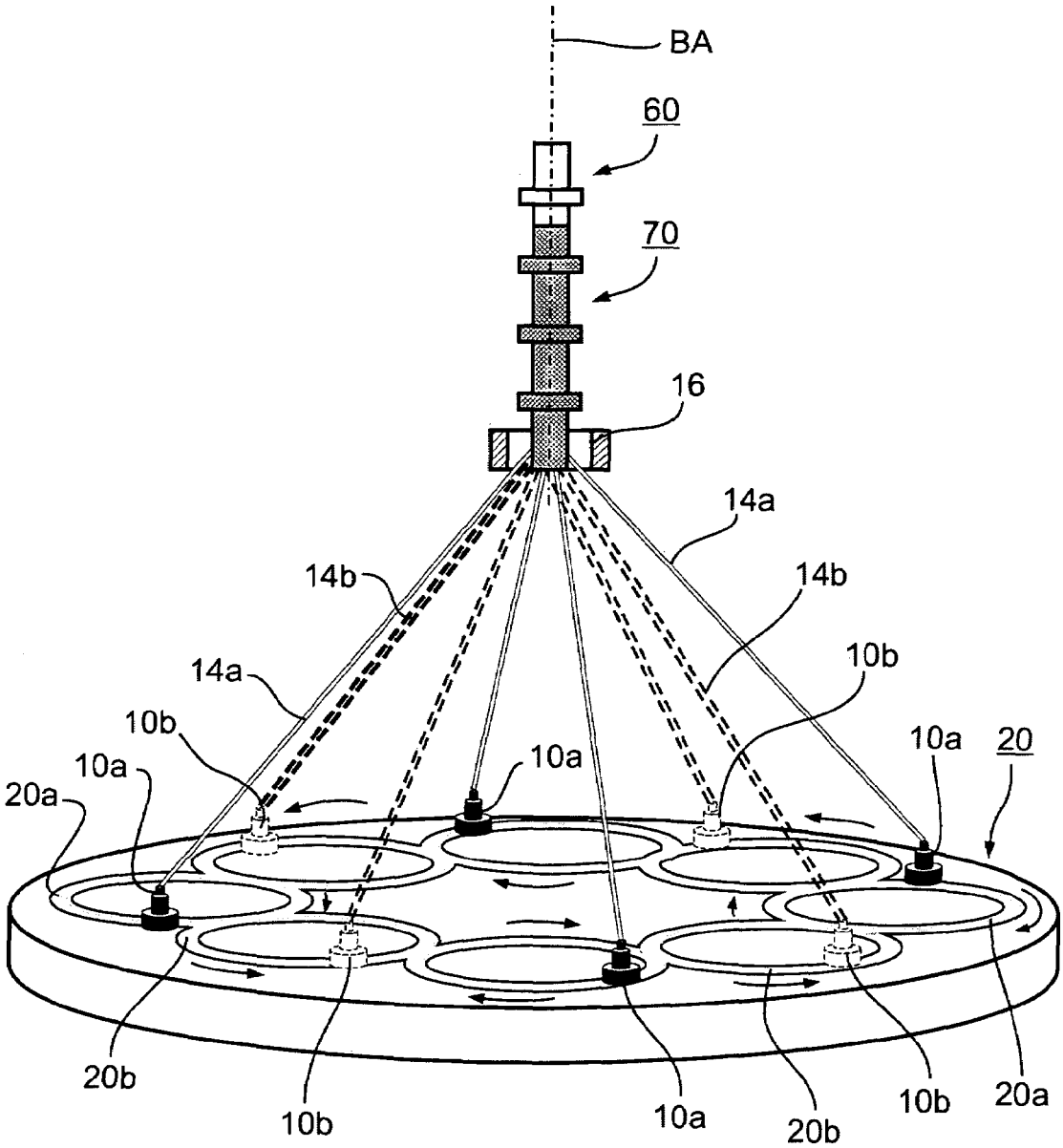
FIG. 1 diagrammatically illustrates one form of braiding apparatus that may be used for making braided devices in accordance with the present invention.

The present embodiments enable a braided device comprising multiple filament types, in which at least one of the filament types define an independent stable structure of a symmetrical 1×1 sub-pattern, the multiple filament types being braided together into a single layer braided device exhibiting a uniform braid pattern. The present embodiments also enable a method of braiding multiple filaments types into a single uniform braid pattern in which one of the filament types define an integral symmetric 1×1 sub-pattern.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Braiding Machine Construction (FIGS. 1–12)

The invention is particularly useful when embodied in the "Maypole" type of braiding machine, as sold by Steeger USA, Inc. of Spartanburg, S.C., or Wardwell Braiding Machine Company, Central Falls, R.I. The invention is therefore described below with respect to such a braiding machine. The invention is particularly useful, and is therefore also described below, for making braided tubes of ultra-fine filaments, in the order of 50 μm and less, for use in implantable intraluminal devices, such as stents, stent grafts, prevention devices such as filters and stroke prevention devices such as diverters, for implantation in the human body. It will be appreciated, as indicated above, that the invention could also be advantageously implemented in other braiding machines and methods, and could be used for making braids for other applications.

The term filament as used herein is to be understood to include strands, round wires, non-round wires, monofilaments, slit tape, multifilament yarn, braids or other longitudinal product. A single layer braid is defined as braid having a single distinct or discreet layer. A multi-layered braided structure is defined as a structure formed by braiding wherein the structure has a plurality of discreet and distinct layers. Typically, the layers of a multi-layered braided structure are bound by interlocking filaments, adhesives laminates, sewing or the like.

FIG. 1 diagrammatically illustrates a braiding machine of the foregoing Maypole type. It includes a plurality of carriers divided into two groups, 10*a*, 10*b*. Each carrier mounts a spool 12 (FIG. 2) carrying supply of a filament 14 to be interwoven into a braid. The filaments 14*a*, 14*b* of all the carriers 10*a*, 10*b*, respectively, are converged towards the braiding axis BA through a braiding guide 16 located distally from the plurality of carriers 10*a*, 10*b*. Filaments 14*a*, 14*b*, generally filaments 14, are thus interwoven into a braid 70 about a mandrel 60 passing through the braiding guide 16.

The illustrated apparatus further includes an interweaving mechanism housed within a housing generally designated 20 for driving the carriers 10*a*, 10*b* and for paying out the filaments 14 from their respective spools 12. The filaments are thus payed out in an interweaving manner towards the braiding guide 16 to form the braid 70 about the mandrel 60.

The braiding apparatus illustrated in FIG. 1 is of the vertical type; that is, the braiding axis BA of the mandrel 60, about which the braid 70 is formed, extends in the vertical direction. A vertical-type braiding apparatus provides more convenient access by the operator to various parts of the apparatus than the horizontal-type apparatus wherein the braid is formed about a horizontal axis. This is however not meant to be limiting in any way, and the invention is equally applicable to a horizontal-type apparatus. In the illustrated vertical-type apparatus, the interweaving mechanism is within a flat horizontal housing 20, and includes a drive for driving the two groups of carriers 10*a*, 10*b* such as to interweave the filaments 14 of their respective spools as they are payed out towards the braiding guide 16. Each carrier of the two groups 10*a*, 10*b* illustrated in FIG. 1 carries a spool of the filament 14 to be payed out by the respective carrier. Carriers 10*a* are arrayed in a circular array around the braiding axis BA and are driven in one direction about that axis. Carriers 10*b* are also arrayed, in a circular array around the braiding axis BA, alternatingly with respect to carriers 10*a*, and are driven in the opposite direction about that axis.

For purposes of example, FIG. 1 illustrates the carriers 10*a* in full lines as being driven about braiding axis BA in the clockwise direction; whereas carriers 10*b*, shown in broken lines, are driven about braiding axis BA in the counter-clockwise direction. The flat horizontal housing 20 houses a drive mechanism (to be more particularly described below with respect to FIGS. 4–12) which drives carriers 10*a* along a circuitous path shown in full lines at 20*a*, and drives the carriers 10*b* along another circuitous path, shown by broken lines 20*b*, intersecting with the full-line circuitous path 20*a*. As shown in FIG. 1, the circuitous path 20*a* for carriers 10*a*, and also the circuitous path 20*b* for carriers 10*b*, bring the respective carriers 10*a*, 10*b* radially inwardly and outwardly with respect to the braiding axis BA, as the carriers move around the braiding axis.

Since such an interweaving mechanism is well known in braiding machines of this type, as described for example in the published literature available from the manufacturers of such machines, full details of the construction and operation of such an interweaving mechanism are not set forth herein.

Figure 2:
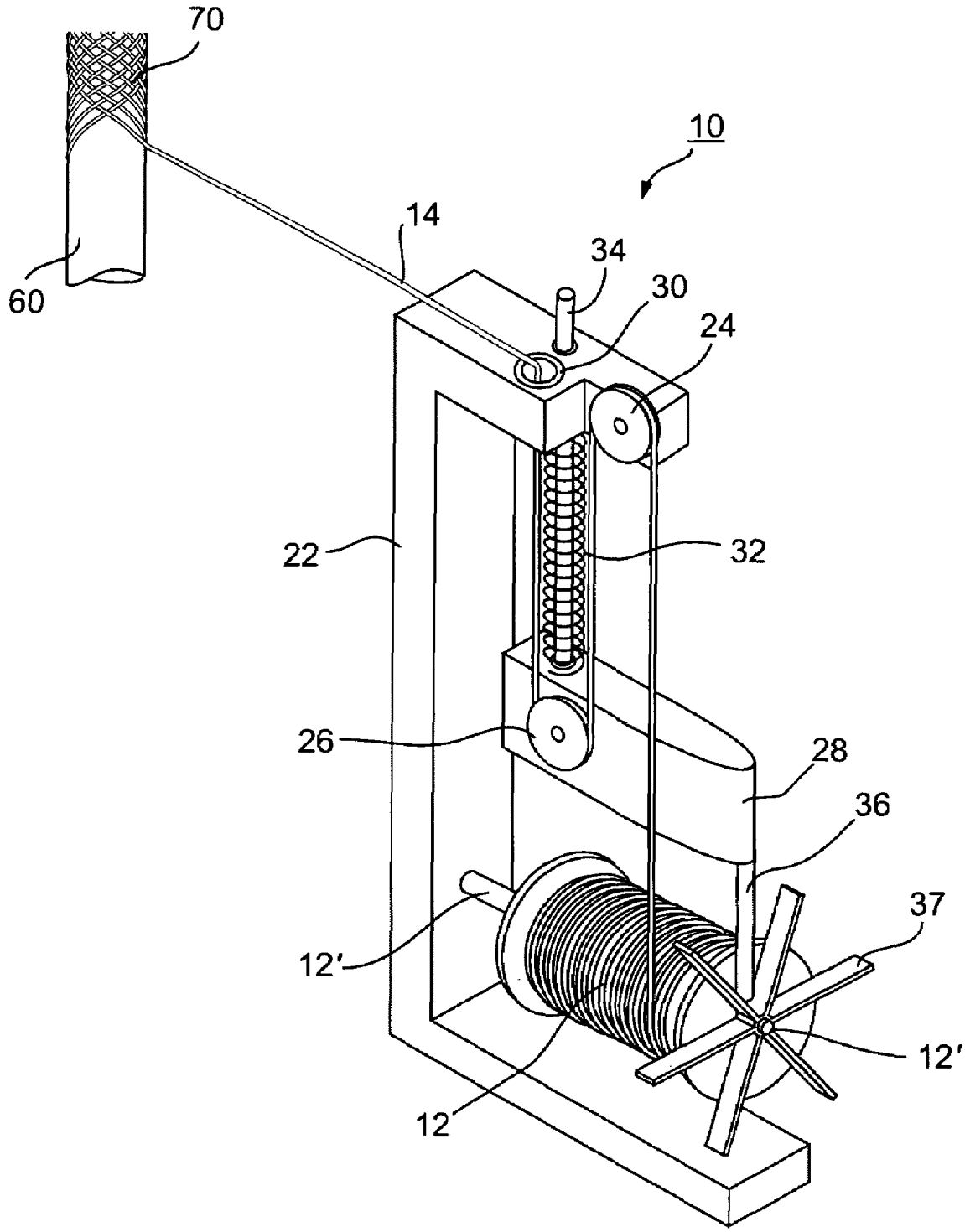
FIG. 2 illustrates one of the driven carriers for one of the filament spools in a commercially available braiding machine which may be used in the apparatus of FIG. 1.

FIG. 2 illustrates one structure that may be provided for each of the carriers 10*a*, 10*b*, mounting one of the spools 12 for the respective filament 14. As shown in FIG. 2, each carrier, therein generally designated 10, includes a vertically-extending mounting member 22 rotatably mounting the respective filament spool 12 for rotation about a horizontal axis. Spool 12 could be mounted to rotate with respect to its shaft 12' or could be fixed to its shaft and both rotated with respect to mounting member 22.

In the embodiment illustrated in FIG. 2, each carrier mounting member 22 mounts an upper roller 24 and a lower roller 26 above the spool 12, each roller being rotatably mounted about a horizontal axis. The upper roller 24 is rotatably mounted on the carrier mounting member 22; whereas the lower roller 26 is rotatably mounted on a movable mounting member 28 which is vertically displaceable with respect to roller 24 and mounting member 22. Each filament 14 is fed from its respective spool 12 over the upper roller 24, and under the lower, vertically-displaceable roller 26, and through an upper eyelet 30 to the braiding guide 16 of FIG. 1. Braiding guide 16 converges all the filaments to produce the braid 70 over the mandrel 60 coaxial with the braiding axis BA.

One of the problems in braiding machines of this type is the need for applying the appropriate tension to the filaments 14 so as not to break or deform the filament by an unduly large tension, or to produce a sag in the filament, particularly the portion between the upper eyelet 30 and the braiding guide 16, which may cause entanglement with other filaments as their respective carriers 10 are rotated about the braiding axis BA. Braiding machines of this type usually include a spring arrangement for applying the appropriate tension to the filaments. FIG. 2 illustrates such a spring, at 32, applied between the carrier mounting member 22 mounting the upper roller 24, and the vertically-displaceable mounting member 28 mounting the lower roller 26. The vertical displacement of mounting member 28, and thereby of the lower roller 26, is guided by a rod 34 movable within an opening in the upper roller mounting member 22.

FIG. 2 further includes the vertically-displaceable mounting member 28 for the lower roller 26 as provided with a depending finger 36 movable within recesses defined by a retainer member 37 fixed to the spool shaft 12' to restrain the spool shaft from free rotation.

Since the force applied by springs, such as spring 32, generally varies with the loaded condition of the spring, the tensioning force produced by such a spring would generally not be constant and uniform because of the movement of the carriers, radially inwardly and outwardly, as they are driven in opposite direction about the braiding axis BA. This problem is particularly acute when braiding ultra-fine filaments, such as wires of 50 μm in diameter and less, since an unduly high tensioning force applied at any time to such a filament to avoid sagging and the danger of filament entanglement, is liable to rupture or deform the filament before it is formed into the braid.

Figure 3:
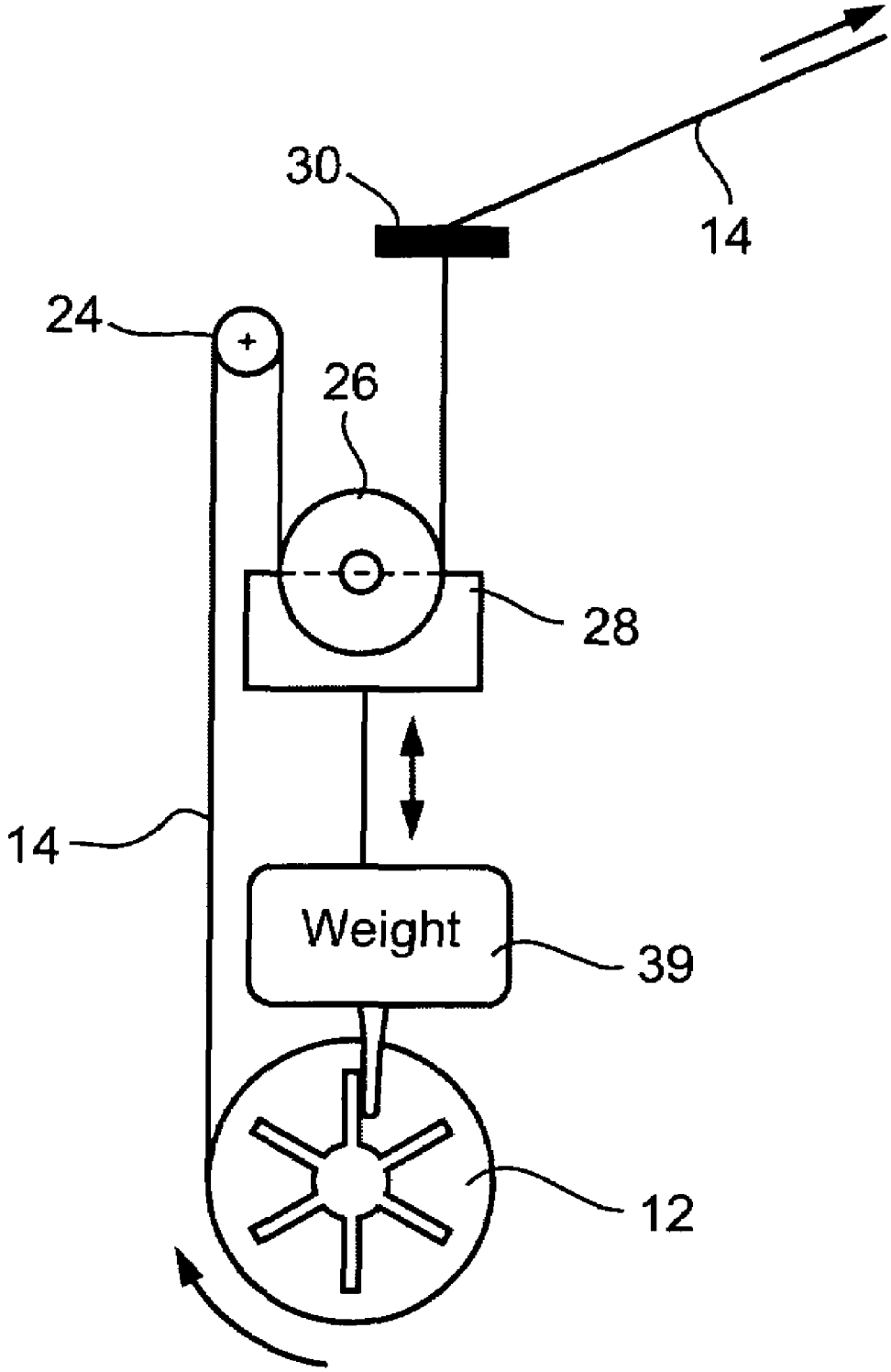
FIG. 3 illustrates a preferred manner of tensioning each of the filaments from its respective spool toward the braiding point in order to produce a uniform tension such as to reduce the possibility of filament rupture or deformation as well as filament entanglement.

FIG. 3 diagrammatically illustrates how the filaments 14 are preferably tensioned in a constant and uniform manner in order to minimize the possibility of over-tensioning likely to cause breakage or deformation, or under-tensioning likely to cause entanglement. Thus, as shown in FIG. 3, the vertically displaceable roller 26 in each of the carriers 10 is provided with a weight, shown at 39, provided with a depending finger 36 engageable with retaining member 37, which applies a gravitational tensioning force to the filament 14 passing under the lower roller 26. Since this tensioning force is a gravitational force applied by the weight 39, it is constant and uniform, and does not vary with the circuitous movements of the carriers as in the case where a spring tensioning force is applied to the filaments.

Each of the carriers of the braiding machine diagrammatically illustrated in FIG. 1 is driven by a rotor formed with four transfer notches for receiving a carrier at one side and transferring it to another rotor at the opposite side. Such rotors are generally in the form of gears, commonly called horn gears, and are disposed within the flat horizontal housing 20. The braiding machine diagrammatically illustrated in FIG. 1 is actually a 8 horn gear braiding machine, which is shown half-loaded, i.e., equipped with 8-carriers only, one carrier per horn gear, divided into the two groups 10*a*, 10*b*.

Figure 4:
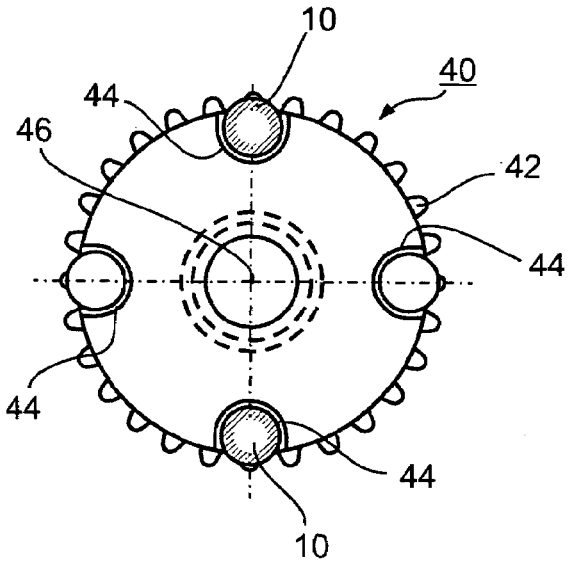
FIGS. 4 and 5 illustrate one loading arrangement for loading the braiding apparatus of FIG. 1 to produce a particular braid pattern, commonly called a Herringbone or 1×2 Braid Pattern, in which each filament of one group of spools is interweaved under and over two filaments of the other group of spools.
Figure 5:
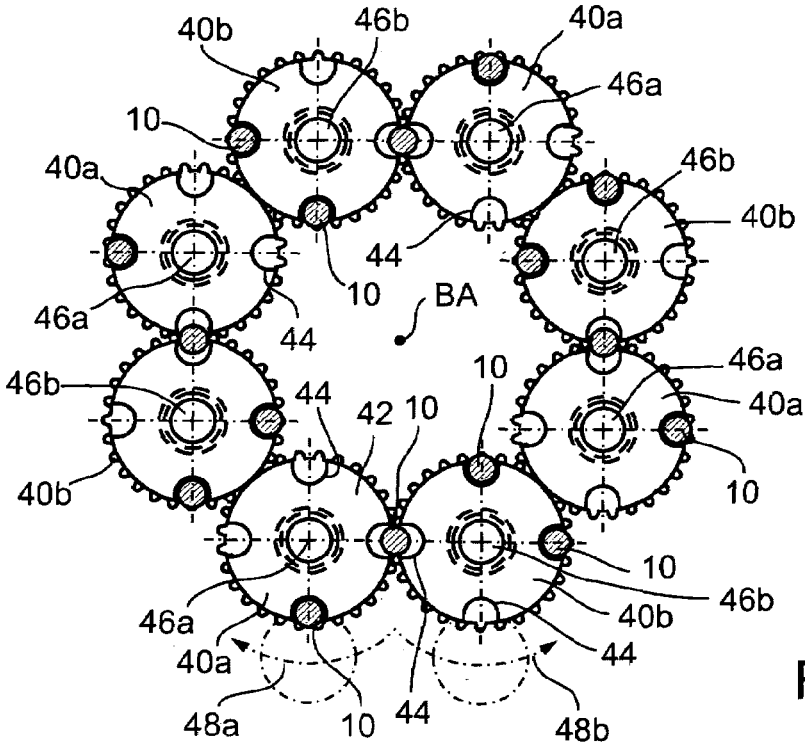

FIG. 4 illustrates one of the horn gears, therein designated 40. It includes circumferential teeth 42 and four transfer notches or pockets, sometimes called horns 44, equally spaced around the circumference of the gear. FIG. 5 illustrates eight of such horn gears 40 arrayed in a circular array around the braiding axis BA and intermeshing with each other so that each horn gear is rotated about its respective axis 46 but in an opposite direction with respect to the adjacent gears on its opposite sides. Thus, with respect to the eight horn gears 40 shown in FIG. 5, one group 40*a* of alternate horn gears rotate clockwise about their respective axes 46*a*, as shown by arrow 48*a*, whereas the other group 40*b* of horn gears rotate in the opposite direction, e.g., counter-clockwise, about their respective axes 46*b*.

As well known in braiding machines of this type, the rotation of each horn gear 40 about its respective axis 46 causes a carrier 10 to be received in a notch 44 from the horn gear at one side and to be transferred to notch 44 of the horn gear at the opposite side. The arrangement is such that the rotation of the two groups of horn gears 40*a*, 40*b* in opposite directions around their respective axes 46*a*, 46*b* is effective to drive the two groups of carriers 10*a*, 10*b* in opposite directions around the braiding axis BA, and along circuitous paths extending radially inwardly and outwardly with respect to the braiding axis. The results is to interweave the filaments 14 of the spools 12 carried by the two groups of carriers 10*a*, 10*b* as the filaments converge at the braiding guide 16 to form the braid 70 around the mandrel 60.

The mechanism for rotating the horn gears 40*a*, 40*b*, such as to drive the carriers 10*a*, 10*b* in opposite directions along their respective serpentine paths, is well known in braiding machines of this type, as described for example in the published literature available with respect to the two commercial designs of braiding machines referred to above and incorporated herein by reference.

Such braiding machines are capable of producing various types of braid patterns, according to the manner of loading the horn gears 40. For purposes of example, three such braiding patterns are described below with respect to FIGS. 4–6, FIGS. 7–9, and FIGS. 10–12, respectively.

Figure 6:
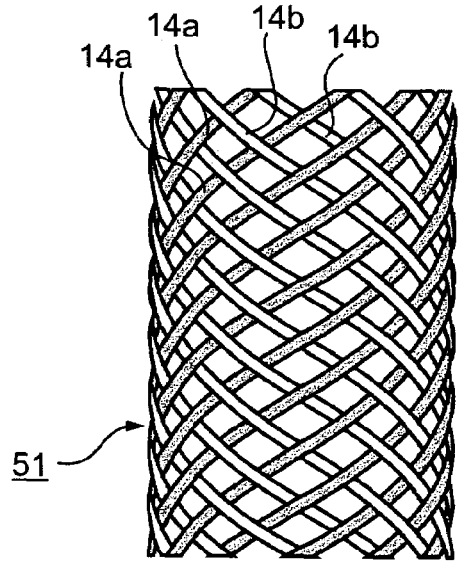
FIG. 6 illustrates the Herringbone or 1×2 Braid Pattern produced by the arrangement of FIGS. 4 and 5.

FIGS. 4–6 relate to producing a regular braid pattern, which is the most commonly used one, sometimes called a Herringbone Pattern, or a 1×2 braid pattern. In such a pattern, each filament of carriers group 10*a* is passed over and under two filaments of carrier group 10*b*. To produce this pattern, each horn gear 40 is loaded with a carrier 10 as shown in FIG. 4, namely with alternative notches 44 of each horn gear 40 occupied by a carrier, whereas the remaining alternate notches 44 of each horn gear 40 are not occupied by a carrier.

FIG. 5 illustrates the manner in which the carriers 10 are transferred from one horn gear 40 to the next as each horn gear rotates about its respective axis 46. As shown by arrow 48*a* in FIG. 5, it will be assumed that the horn gears of group 40*a* are rotated clockwise about their respective axis 46*a*, whereas the horn gears of group 40*b* are rotated counter-clockwise about their respective axes 46*b* as indicated by arrow 48*b*.

FIG. 6 illustrates the 1×2 braid pattern 51 produced in this set-up, wherein it will be seen that each filament 14*a* from the carriers 10*a* rotating in one direction about the braiding axis BA is interweaved over two and under two filaments 14*b* of the carriers 10*b* rotating in the opposite direction around the braiding axis. The 1×2 braid pattern is characterized by relatively large area coverage of the braid, however the structural stability of the braid pattern is somewhat lower than the 1×1 braid pattern to be discussed further below.

Figure 7:
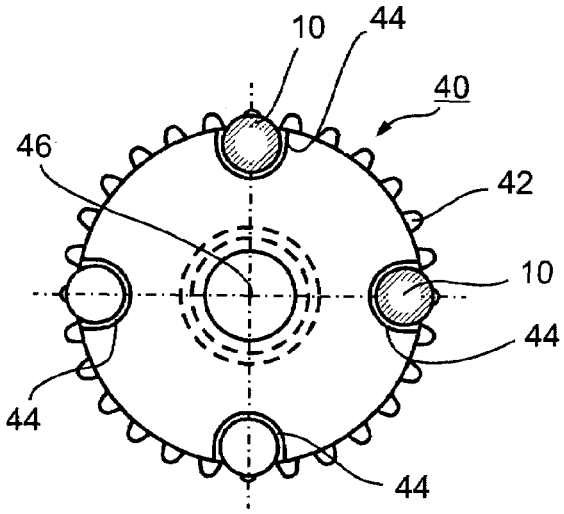
FIGS. 7 and 8 illustrate another loading arrangement for producing another broad pattern, commonly called a Diamond or Double Filament 1×1 Braid Pattern, in which two contiguous filaments of one group of spools are interleaved under and over two contiguous filaments of the other group of spools.
Figure 8:
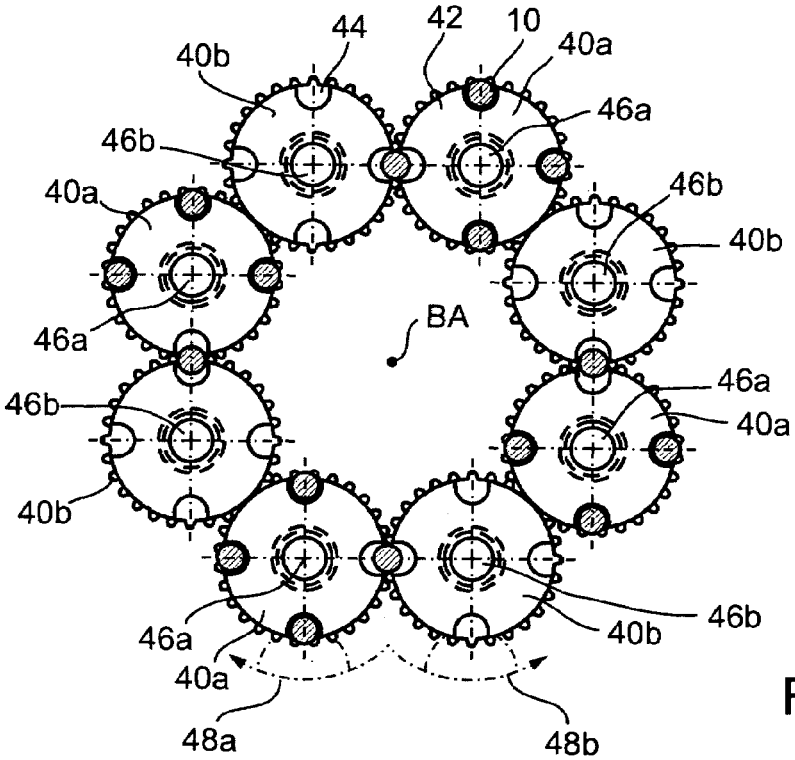

FIG. 7 illustrates the set-up of the horn gears 40 for producing a double filament diamond braid pattern, also known as a double filament 1×1 braid pattern, in which two filaments 14*a* from carriers 10*a* rotating in one direction run contiguously and are interweaved over and under two filaments 14*b* from carriers 10*b* rotating in the opposite direction. FIG. 7 illustrates the loading arrangement for the horn gears to produce such a pattern, in which it will be seen that two adjacent notches 44 are loaded with a carrier, whereas the remaining two adjacent notches are not loaded. FIG. 8 illustrates how the carriers are transferred from one horn gear to the next during the rotation of all the horn gears about their respective axes 46. Thus, the clockwise rotation of horn gears 40*a*, about their respective axes 46*a*, as shown by arrow 48*a*, effects the clockwise transfer of the carriers 10*a* around the braiding axis BA; whereas the counter-clockwise rotation of the horn gears 40*b* about their respective axes 46*b*, as shown by arrow 48*b*, effects the counter-clockwise transfer of the carriers 10*b* around the braiding axis BA.

Figure 9:
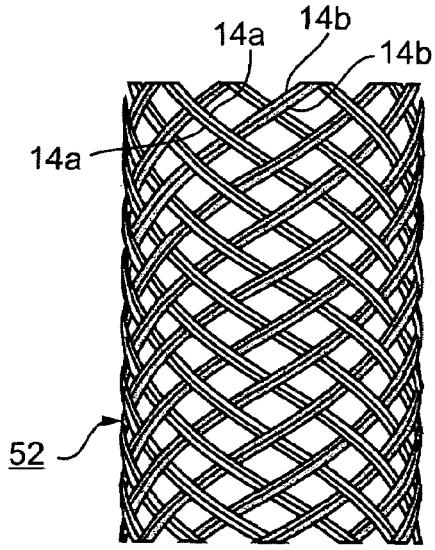
FIG. 9 illustrates the Diamond or Double Filament 1×1 Braid Pattern produced by the loading arrangement of FIGS. 7 and 8.

FIG. 9 illustrates the double filament 1×1 braid pattern 52 so produced, wherein it will be seen that two filaments 14*a* each from a carrier 10*a* rotated in the clockwise direction are run contiguously and are interwoven over and under two filaments 14*b* each from a carrier 10*b* rotated by the horn gears 40*b* in the counter-clockwise direction. The double filament 1×1 braid pattern is characterized by an improved structural stability of the braid pattern but reduced coverage, as compared to the 1×2 braid pattern described above in relation to FIG. 6.

Figure 10:
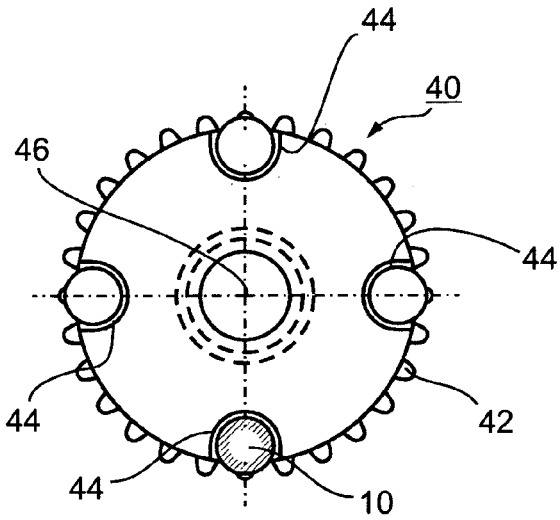
FIGS. 10 and 11 illustrate a further loading arrangement for producing another Diamond or Single Filament 1×1 Braid Pattern in which each filament of one group of spools is interweaved under and over a single filament of the second group of spools.
Figure 12:
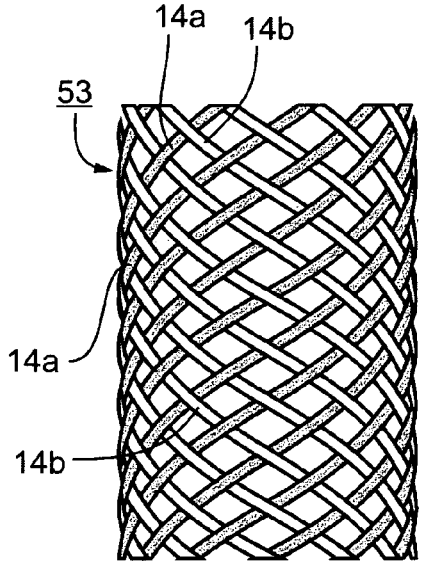
FIG. 12 illustrates the Diamond or Single Filament 1×1 Braid Pattern produced by the loading arrangement of FIGS. 10 and 11.
Figure 11:
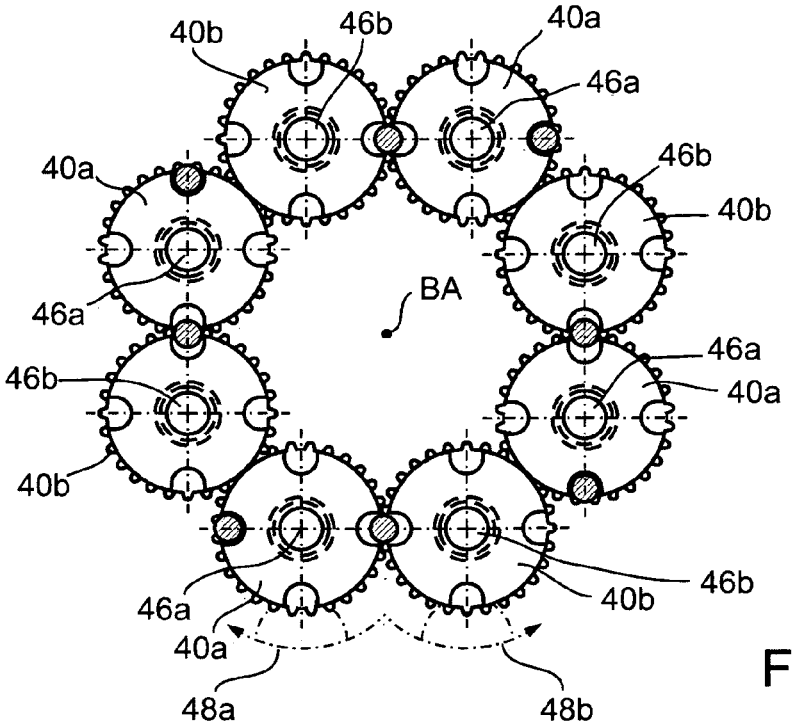

FIG. 10–12 illustrate the manner of producing a braid pattern also of a diamond or 1×1 braid pattern but in which each filament 14*a* from the carriers 10*a* is interwoven over and under a single filament 14*b* from the carriers 10*b*. As shown in FIG. 10, to produce such a pattern, the horn gears 40 are loaded with a carrier 10 in only one of the notches 44, the remaining three notches 44 being without carriers. Thus, as shown in FIG. 11, the horn gears 40*a* rotating in the clockwise direction about their respective axes 46*a*, as indicated by arrow 48*a*, effect the transfer of the carriers 10*a* in the clockwise direction about the braiding axis BA, whereas the horn gears 40*b* rotating in the counter-clockwise direction about their respective axes 46*b*, as indicated by arrow 48*b* in FIG. 11, effect the transfer of the carriers 10*b* in the counter-clockwise direction about the braiding axis.

FIG. 12 illustrates the single filament 1×1 braid pattern 53 so produced, wherein it will be seen that each filament 14*a* of a carrier 10*a* is interwoven over and under each filament 14*b* of a carrier 10*b*. The single filament 1×1 braid pattern is characterized by improved structural stability of the braid pattern as compared to the 1×2 braid pattern described above in relation to FIG. 6 and reduced coverage as compared to the double filament 1×1 braid pattern described above in relation to FIG. 9.

Further details of the construction of such braiding machines, and the manner of their use in producing various braid patterns, are available in the published literature of the above-cited suppliers of such machines incorporated herein by reference as background material.

The invention of the present application is concerned primarily with a single layer braided device comprising multiple types of filaments 14, the filaments exhibiting differing mechanical characteristics, the filaments of at least one type being braided in an integrated symmetrical lxl sub-pattern. Preferably, the more rigid filament is braided as an integrated symmetrical 1×1 sub-pattern. More preferably, the integrated symmetrical sub-pattern of filaments supplies at least 75% of the overall rigidity of the braided device, and even more preferably at least 90% of the overall rigidity of the braided device. In another embodiment, the integrated symmetrical sub-pattern of filaments supplies radio-opacity for the braided device, the filaments of the sub-pattern being comprised of a radiopaque substance of sufficient cross section to be visible under commercially available fluoroscopic equipment.

Figure 13:
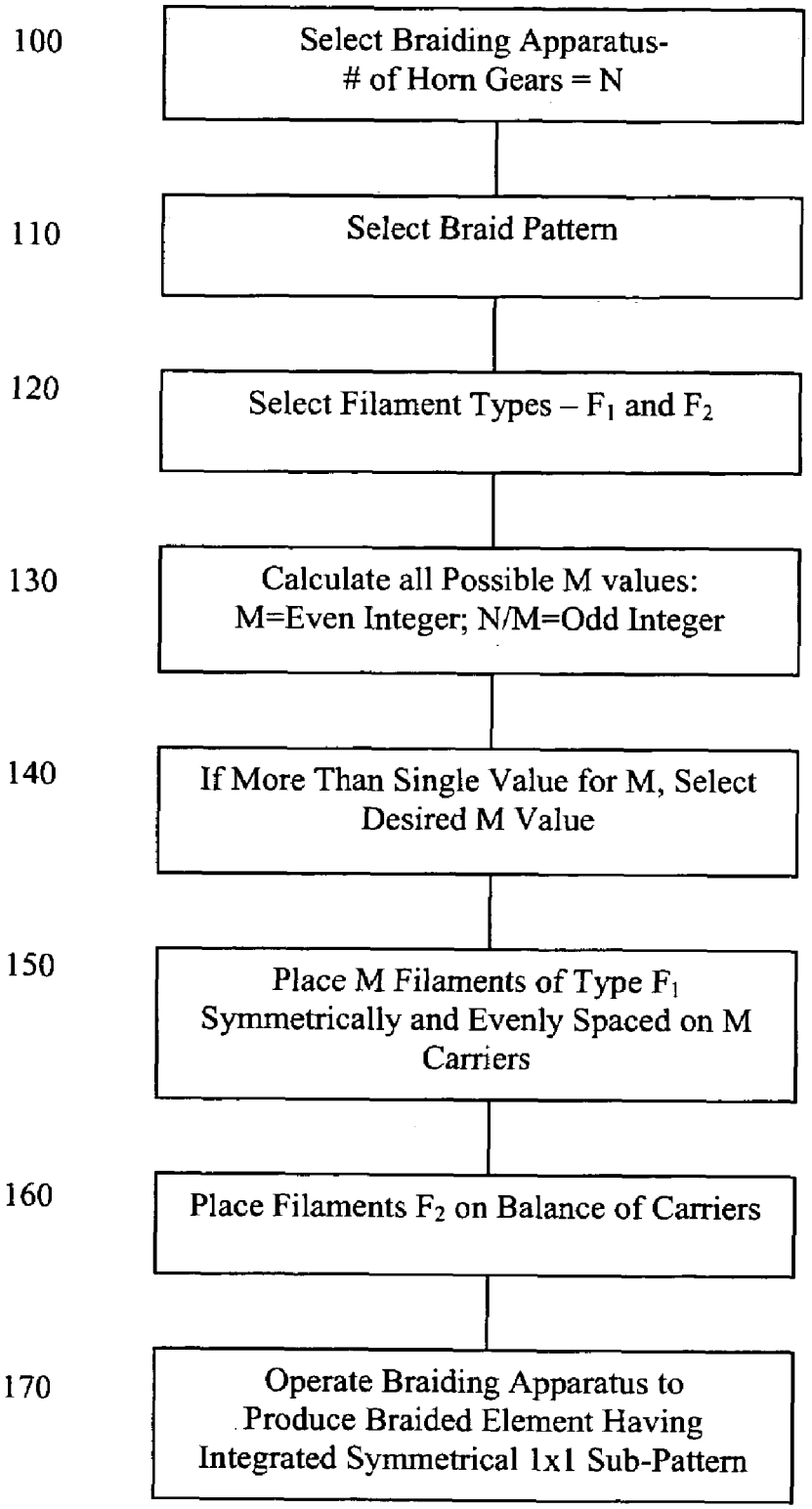
FIG. 13 illustrates a high level flow chart of a first embodiment of a braiding method according to the principle of the current invention.

FIG. 13 illustrates a high level flow chart of a first embodiment of a braiding method according to the principle of the current invention, in which filament multiple filament types, comprising a first filament type hereinafter being designated $F_1$, and a second filament type hereinafter designated $F_2$ are braided together into a braid exhibiting a uniform braid pattern, in which filaments of type $F_1$ define an integrated symmetrical 1×1 sub-pattern. In step 100, the braiding apparatus is selected, the selected braiding apparatus being characterized by having horn gears, the number of horn gears of the selected braiding apparatus being hereinafter designated N. As indicated above in relation to FIG. 10-12, for a single filament 1×1 braid pattern, the number of carriers is equal to the number of horn gears.

In step 110, the braid pattern to be utilized in the operation of the braiding apparatus selected in step 100 is selected. As indicated above, the braid pattern is chosen from the possible braid patterns producible by the appropriate loading of the N horn gears of the braiding apparatus selected in step 100.

In step 120, the multiple filament types to be utilized, comprising first filament type $F_1$, and second filament type $F_2$, are selected. The method is herein being described as having two types of filaments, however this is not meant to be limiting in any way. Three or more types of filaments may be utilized without exceeding the scope of the invention. Filament type $F_1$ is the filament type that is to be braided in an integrated symmetrical 1×1 sub-pattern. Preferably, the more rigid filament type of the multiple filament types utilized is selected as $F_1$.

In step 130, possible values for the number of filaments in the integrated symmetrical 1×1 sub-pattern, herein designated M, are calculated. Values for M meet the following criteria:

$$M = \text{even integer} \qquad \text{Equation 1}$$

$$N/M = \text{odd integer} \qquad \text{Equation 2}$$

In step 140 the results of step 130 are analyzed. If no values for M are found, a different braiding apparatus is selected. If multiple values for M have been found that meet the requirements of Equation 1 and Equation 2, the desired M value is selected. In an exemplary embodiment, the more rigid filament type is selected as $F_1$, and the mechanical characteristics of filament type $F_1$ and the required overall mechanical device characteristics are analyzed, with the resultant minimum value for M that supplies the device with the required mechanical characteristics is chosen. In an exemplary embodiment in which N=72, the values M=8, and M=24 and M=72 meet the requirement of Equation 1 and Equation 2. In the non-limiting embodiment in which the braided device exhibits a 1×1 single filament braid pattern, the value M=72 results in single filament type being utilized throughout the device, and thus will not result in a braided device having multiple filament types, and is therefore not used.

In step 150, M filaments of type $F_1$ are symmetrically and evenly placed on carriers. Symmetrical and even placement as used herein includes circular symmetry as well as even distribution among the carriers of the braiding apparatus such that selected carriers are evenly spread out in the circular array of carriers 10*a* and 10*b*. Thus half of M filaments of type $F_1$ are loaded on carriers 10*a* of FIG. 1, carriers 10*a* being selected symmetrically and evenly from among all carriers 10*a*, and half of M filaments of type $F_1$ are loaded on carriers 10*b* of FIG. 1, carriers 10*b* being selected symmetrically and evenly on carriers 10*b* of FIG. 1 from among all carriers 10*b*. It is to be noted that the selection of carriers 10*a* and 10*b* is not independent, and carriers 10*a* and 10*b* are to be selected to symmetrical and evenly spaced respect to all carriers 10.

In step 160, the remaining carriers are loaded with filaments of type $F_2$. In the non-limiting embodiment of an overall single filament 1×1 braid type, there are N-M unloaded carriers which are loaded with filaments $F_2$, thus in the exemplary embodiment indicated above, utilizing a single filament 1×1 braid type, there are 48 filaments $F_2$.

In step 170, the braiding apparatus is operated in a manner known to those skilled in the art to produce a braided device comprising multiple filament types, in which one of the filament types define an independent stable structure of a symmetrical 1×1 sub-pattern, the multiple filament types being braided together into a braided device exhibiting a uniform braid pattern.

Figures 14, 16A:
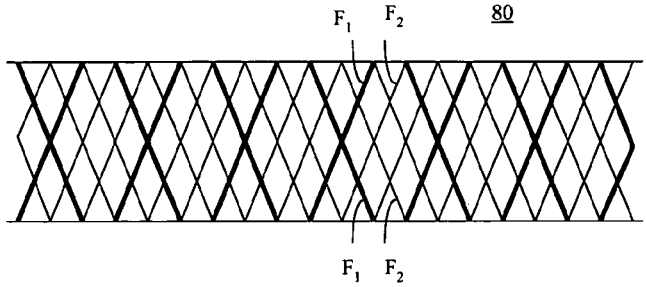

FIG. 14 illustrates a high level side view of a braided device 80 in accordance with the principle of the current invention, comprising filament types $F_1$ and filament type $F_2$. Filament type $F_1$ is illustrated with heavier lines than filament type $F_2$, however this is not meant to be limiting in any way. Filament types $F_1$ and $F_2$ form a braided device 80, in which filament types $F_1$ form an integrated symmetrical 1×1 sub-pattern.

Figure 15:
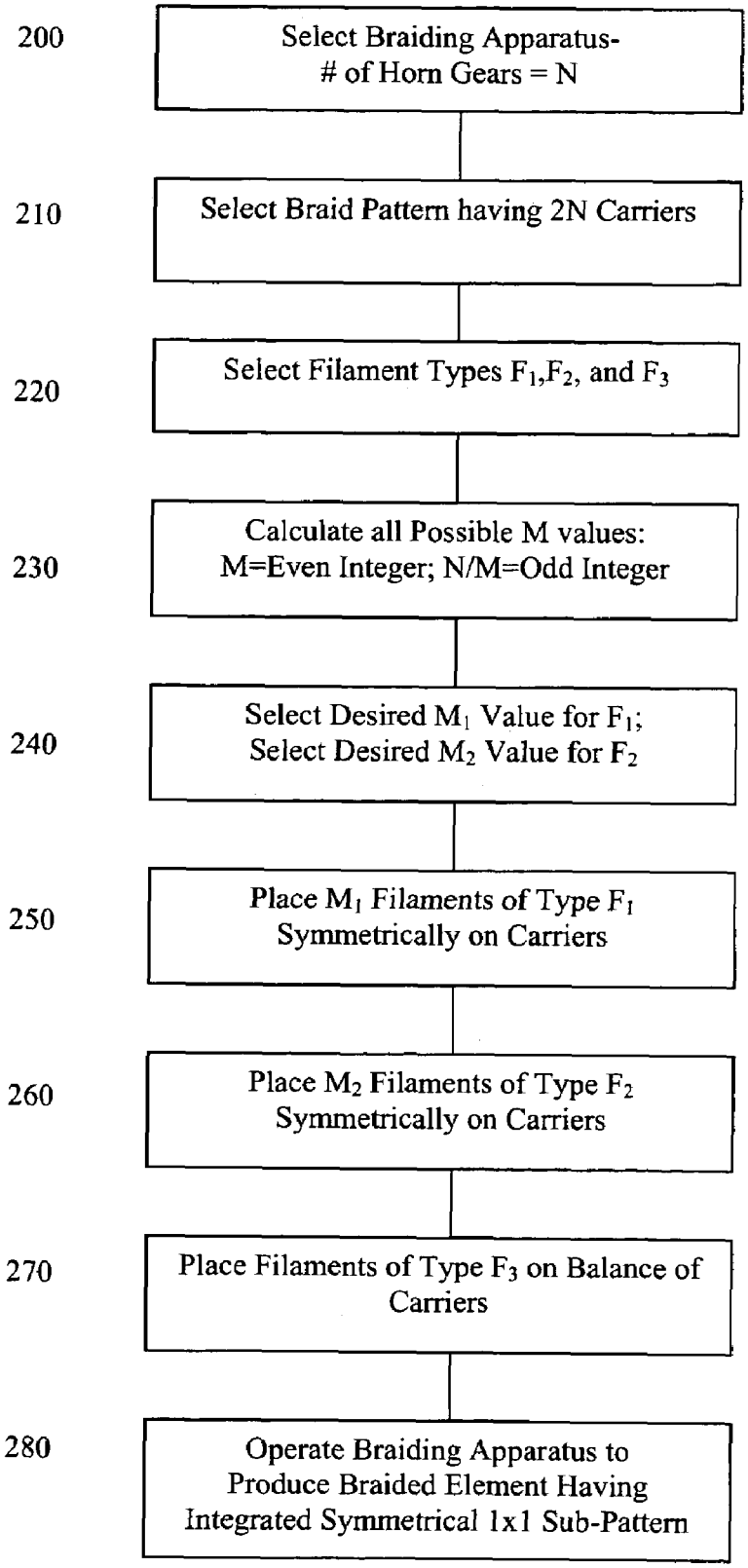
FIG. 15 illustrates a high level flow chart of a second embodiment of a braiding method according to the principle of the current invention.

FIG. 15 illustrates a high level flow chart of a second embodiment of a braiding method according to the principle of the current invention, in which multiple filament types, comprising a first filament type hereinafter being designated $F_1$, and a second filament type hereinafter designated $F_2$, and a third filament type hereinafter being designated $F_3$, are braided together into a braid exhibiting a uniform braid pattern, in which filaments of type $F_1$ define a first integrated symmetrical 1×1 sub-pattern and filaments of type $F_2$ define a second integrated symmetrical 1×1 sub-pattern. The braiding method is herein being described as having two individual integrated symmetrical 1×1 sub-patterns, however this is not meant to be limiting in any way. In another embodiment three or more multiple integrated sub-patterns are defined within an overall uniform braid pattern without exceeding the scope of the invention.

In a preferred embodiment the overall braid pattern is a 1×2 braid pattern as described above in relation to FIG. 4–6. In another preferred embodiment the overall braid pattern is a double filament 1×1 braid pattern as described above in relation to FIG. 7–9. In yet another preferred embodiment the overall braid pattern is a single filament 1×1 braid pattern as described above in relation to FIG. 10–12. In step 200, the braiding apparatus is selected, and the number of horn gears of the braiding apparatus is designated N.

In step 210, the braid pattern to be utilized in the operation of the braiding apparatus selected in step 200 is selected. As indicated above, the braid pattern is chosen from the possible braid patterns producible by the appropriate loading of the N horn gears of the braiding apparatus selected in step 200.

In step 220, the types of filaments to be utilized, $F_1$ and $F_2$ are selected. A third filament type, $F_3$, which comprises the balance of the filaments to be utilized, is also selected. The method is herein being described as having three different types of filaments, however this is not meant to be limiting in any way. In one embodiment, filament type $F_3$ is in all respects identical with filament type $F_1$ or $F_2$, but is not part of the first or second integrated 1×1 symmetrical sub-pattern of filament type $F_1$ or $F_2$, respectively. In another embodiment filament types $F_{1\ and\ F2}$ are in all respects identical but differ from filament type $F_3$, and first and second integrated 1×1 symmetrical sub-patterns of filament types $F_{1\ and\ F2}$, respectively are created.

In step 230, the possible values for the number of filaments in the integrated symmetrical 1×1 sub-pattern, herein designated generally as M, are calculated. Values for M meet the requirements of Equation 1 and Equation 2 described above.

In step 240 the results of step 230 are analyzed. In the event only one value is found, the number of filaments of type $F_1$ in the first integrated symmetrical 1×1 sub-pattern, hereinafter designated $M_1$, and the number of filaments of type $F_2$ in the second integrated symmetrical 1×1 sub-pattern, hereinafter designate $M_2$, are set to this value. In the event that two or more values of M have been found, a value of M that will result in the desired characteristic of the braided device is selected for each of $M_1$ and $M_2$. Thus $M_1$ may be the same as $M_2$, greater than or less than $M_2$. In an exemplary embodiment in which N=72, the values M=8, M=24 and M=72 meet the requirement of Equation 1 and Equation 2, and thus $M_1$ may be set to 8, 24 or 72, and $M_2$ may be set to 8, 24 or 72. In a first preferred embodiment the more rigid filament type is selected as $F_1$, and the mechanical characteristics of $F_1$ together with the required overall mechanical device characteristics are reviewed. The minimum value for $M_1$ that supplies the device with the required mechanical characteristics is selected. In a second preferred embodiment, the more rigid filament type is selected as filament type $F_1$ and $F_2$, and the mechanical characteristics of $F_1$, $F_2$ together with the required overall mechanical device characteristics are reviewed. The minimum value for $M_1$ and $M_2$ that supply the device with the required mechanical characteristics is selected.

In step 250, $M_1$ filaments of type $F_1$ are symmetrically and evenly placed on carriers. Symmetrical and even placement as used herein includes circular symmetry as well as even distribution among the carriers of the braiding apparatus such that selected carriers are evenly spread out in the circular array of carriers 10*a* and 10*b*. Thus half of $M_1$ filaments of type $F_1$ are loaded on carriers 10*a* of FIG. 1, carriers 10*a* being selected symmetrically and evenly from among all carriers 10*a*, and half of $M_1$ filaments of type $F_1$ are loaded on carriers 10*b* of FIG. 1, carriers 10*b* being selected symmetrically and evenly on carriers 10*b* of FIG. 1 from among all carriers 10*b*. It is to be noted that the selection of carriers 10*a* and 10*b* is not independent, and carriers 10*a* and 10*b* are to be selected to symmetrical and evenly spaced respect to all carriers 10.

In step 260, $M_2$ filaments of type $F_2$ are symmetrically placed on carriers. Symmetrical and even placement as used herein includes circular symmetry as well as even distribution among the carriers of the braiding apparatus such that selected carriers are evenly spread out in the circular array of carriers 10*a* and 10*b*. Thus half of $M_2$ filaments of type $F_2$ are loaded on carriers 10*a* of FIG. 1, carriers 10*a* being selected symmetrically and evenly from among all carriers 10*a*, and half of $M_2$ filaments of type $F_2$ are loaded on carriers 10*b* of FIG. 1, carriers 10*b* being selected symmetrically and evenly on carriers 10*b* of FIG. 1 from among all carriers 10*b*. It is to be noted that the selection of carriers 10*a* and 10*b* is not independent, and carriers 10*a* and 10*b* are to be selected to symmetrical and evenly spaced respect to all carriers 10. It is to be further noted that placement of filament type $F_2$ is independent of placement of filament type $F_1$, thus filament type $F_2$ need not be placed symmetrically and evenly in relation to filament type $F_1$ In a preferred embodiment, placement of filament type $F_2$ is done symmetrically in relation to placement of filament type $F_1$, thus contributing to the overall symmetry of the braided device.

In step 270, the remaining carriers are loaded with filaments type $F_3$. For the embodiments in which the overall braid pattern represents a 1×2 braid pattern, or a double filament 1×1 braid pattern there are $2N-(M_1+M_2)$ unloaded carriers that are loaded with filament type $F_3$.

In step 280, the braiding apparatus is operated in a manner known to those skilled in the art to produce a braided device comprising multiple filament types in which first filament type $F_1$, second filament type $F_2$, and third filament type $F_3$, are braided together into a braided device exhibiting a uniform braid pattern, in which filaments of type $F_1$ define a first integrated symmetrical 1×1 sub-pattern and filaments of type $F_2$ define a second integrated symmetrical 1×1 sub-pattern.

FIG. 16*a*–FIG. 16*d* illustrate high level schematic views of the loading of a Maypole type braiding apparatus comprising 36 horn gears, or N=36, in accordance with the principle of the current invention. For ease of understanding, the braiding apparatus is herein illustrated as a two dimensional table, in which the first row represents horn gears being sequentially numbered, with rows below indicating the loading, and direction of travel indicated by an arrow, of carriers on the horn gears. Two solutions exist for the combination of Equation 1 and Equation 2, M=4 and M=12.

FIG. 16*a* illustrates the loading of carriers with filament type $F_1$ and filament type $F_2$ to produce a braided device exhibiting a uniform 1×1 single filament braid pattern, in which filaments of type $F_1$ define an integrated symmetrical 1×1 sub-pattern in accordance with the principle of the current invention. As described above in relation to FIG. 10–FIG. 12, in an exemplary embodiment in which the braid pattern comprises a single filament 1×1 braid pattern, the number of carriers is equal to the number of horn gears. The carriers on which filament type $F_1$ are loaded are illustrated with a spotted background for ease of identification. The single carrier or each of four horn gears, labeled 1, 10, 19, 28, being placed symmetrically and evenly spaced among the horn gears of FIG. 16*a*, are loaded with filament type $F_1$, with the carriers of horn gear 1 and 19 traveling in the opposing direction from the carriers of horn gears 10 and 28.

The balance of the carriers are loaded with filament type $F_2$, and thus filament type $F_1$ forms an integrated symmetrical 1×1 sub-pattern comprising 4 filaments within the braided device comprising a total of 36 filaments.

It is to be understood that in the event that more than two filament types are used, one type of filament is designated $F_1$, which is loaded onto the carriers of the horn gears as described above in relation to FIG. 16*a*, and the balance of the carriers are loaded as symmetrically and evenly as possible split among the remaining filament types.

FIG. 16*b* illustrates the loading of carriers with filament type $F_1$ and filament type $F_2$ to produce a braided device exhibiting a uniform 1×2 braid pattern, in which filaments of type $F_1$ define an integrated symmetrical 1×1 sub-pattern in accordance with the principle of the current invention. As described above in relation to FIG. 4–FIG. 6, in an exemplary embodiment in which the braid pattern is a 1×2 braid pattern, the number of carriers is equal to twice the number of horn gears. The carriers on which filament type $F_1$ are loaded are illustrated with a spotted background for ease of identification. A single carrier or each of four horn gears, labeled 1, 10, 19, 28, being placed symmetrically and evenly spaced among the horn gears of FIG. 16*b*, are loaded with filament type $F_1$, with the carriers loaded with filament type $F_1$ of horn gear 1 and 19 traveling in the opposing direction from the carriers loaded with filament type $F_1$ of horn gears 10 and 28. The balance of the carriers are loaded with filament type $F_2$, and thus filament type $F_1$ forms an integrated symmetrical 1×1 sub-pattern comprising 4 filaments within the braided device comprising a total of 72 filaments exhibiting a 1×2 braid pattern.

It is to be understood that in the event that more than two filament types are used, one type of filament is designated $F_1$, which is loaded onto the carriers of the horn gears as described above in relation to FIG. 16*b*, and the balance of the carriers are loaded as symmetrically and evenly as possible split among the remaining filament types.

FIG. 16*c* illustrates the loading of carriers with filament type $F_1$ and filament type $F_2$ to produce a braided devices exhibiting a uniform double filament 1×1 braid pattern, in which filaments of type $F_1$ define an integrated symmetrical 1×1 sub-pattern in accordance with the principle of the current invention. As described above in relation to FIG. 7–FIG. 9, in an exemplary embodiment in which the braid pattern is a double filament 1×1 braid pattern, the number of carriers is equal to twice the number of horn gears. The carriers on which filament type $F_1$ are loaded are illustrated with a spotted background for ease of identification. A single carrier or each of four horn gears, labeled 1, 10, 19, 28, being placed symmetrically and evenly spaced among the horn gears of FIG. 16*c*, are loaded with filament type $F_1$, with the carriers loaded with filament type $F_1$ of horn gear 1 and 19 traveling in the opposing direction from the carriers loaded with filament type $F_1$ of horn gears 10 and 28. The balance of the carriers are loaded with filament type $F_2$, and thus filament type $F_1$ forms an integrated symmetrical 1×1 sub-pattern comprising 4 filaments within the braided device comprising a total of 72 filaments exhibiting a double filament 1×1 braid pattern.

It is to be understood that in the event that more than two filament types are used, one type of filament is designated $F_1$, which is loaded onto the carriers of the horn gears as described above in relation to FIG. 16*d*, and the balance of the carriers are loaded as symmetrically and evenly as possible split among the remaining filament types FIG. 16*d* illustrates the loading of carriers with filament types $F_1$, $F_2$ and F3, to produce a braided device exhibiting a uniform 1×2 braid pattern, in which filaments of type $F_2$ define a first integrated symmetrical 1×1 sub-pattern, and filaments of type $F_2$ define a second integrated symmetrical 1×1 sub-pattern in accordance with the principle of the current invention, and filament types $F_3$ defines the balance of filaments used in the braided device. The embodiment illustrated comprises 4 filaments of type $F_1$, and 12 filaments of type $F_2$, thus illustrating an implementation in which $M_1$=4, and $M_2$=12. As described above in relation to FIG. 4–FIG. 6, in an exemplary embodiment in which the braid pattern is a 1×2 braid pattern, the number of carriers is equal to twice the number of horn gears. The carriers on which filament type $F_1$ are loaded are illustrated with a spotted background for ease of identification, and the carriers on which filament type F2 are loaded are illustrated with a diagonal background for ease of identification. A single carrier of each of four horn gears, labeled 1, 10, 19, 28, being placed symmetrically and evenly spaced among the horn gears of FIG. 16*d*, are loaded with filament type $F_1$, with the carriers loaded with filament type $F_1$ of horn gear 1 and 19 traveling in the opposing direction from the carriers loaded with filament type $F_1$ of horn gears 10 and 28. A single carrier of each of twelve horn gears, labeled 1, 4, 7, 10, 13, 16, 19, 22, 25, 28, 31 and 34 being placed symmetrically and evenly spaced among the horn gears of FIG. 16*d*, are loaded with filament type $F_2$, with the carriers loaded with filament type $F_1$ of horn gear 1,7, 13, 19, 25 and 31 traveling in the opposing direction from the carriers loaded with filament type $F_1$ of horn gears 4,10, 16, 22, 28 and 34. The balance of the carriers are loaded with filament type $F_3$, and thus filament type $F_1$ forms a first integrated symmetrical 1×1 sub-pattern comprising 4 filaments, filament type $F_2$ forms a second integrated symmetrical 1×1 sub-pattern comprising 12 filaments, within the braided device comprising a total of 72 filaments.

It is to be understood that overall uniformity of the braided device refers solely to the braid pattern, and not to the overall symmetry of the device. Furthermore, the method and braided device described herein is primarily concerned with at least one symmetrical 1×1 sub-pattern, preferably however the overall symmetry of the braided device is preserved.

Furthermore, the use of equations 1 and 2 provide a means for proper selection of a braiding machine, which is capable of producing a braided device comprising multiple filament types having an integrated symmetrical 1×1 sub-pattern of at least one filament type. Such a selection requires calculating the desired number of filaments in the symmetrical 1×1 sub-pattern, and selecting a braiding machine having the appropriate number of horn gears such that equations 1 and 2 are satisfied for the desired number of filaments in the sub-pattern.

Thus the present invention enable a braided device comprising multiple filament types, in which at least one of the filament types define an independent stable structure of a symmetrical 1×1 sub-pattern, the multiple filament types being braided together into a single braided device exhibiting a uniform braid pattern. The present embodiments also enable a method of braiding multiple filaments types into a single uniform braid pattern in which one of the filament types define an integral symmetric 1×1 sub-pattern.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description.

We claim:

1. A braided device comprising:

a plurality (M) of filaments of a first type and a plurality (N) of filaments of a second type;

said filaments of the first type being substantially more rigid than the filaments of the second type;

the plurality (M) of filaments of the first type in said braided device being an even integer;

the ratio N/M being an odd integer;

said first type of filaments defining an integral axis symmetrical 1×1 sub-pattern producing a relatively stable axis symmetrical structure independent of the filaments of the second type and providing at least 75% of the rigidity of the braided device;

wherein the combination of said first type of filaments and said second type of filaments are braided together into a braided device exhibiting a uniform braid pattern.

2. A braided device according to claim 1, wherein said braided device is an implantable intraluminal device.

3. A braided device according to claim 1, wherein said integral axis symmetric 1×1 sub-pattern provides 90% of the rigidity of said braided device.

4. A braided device according to claim 1, wherein said braided device is a stent-graft.

5. A braided device according to claim 1, wherein said braided device is a filter.

6. A braided device according to claim 1 wherein said braid pattern is a single filament 1×1 braid pattern.

7. A braided device according to claim 1 wherein said braid pattern is a double filament 1×1 braid pattern.

8. A braided device according to claim 1 wherein said braid pattern is a 1×2 braid pattern.

9. A method for braiding comprising:

selecting a braiding apparatus having a number of horn gears, the number of horn gears being designated N;

selecting a first filament type and a second filament type, said filaments of the first type being substantially more rigid than the filaments of the second type; and loading said first filament type on carriers on said horn gears, such that the number of horn gears being loaded, designated M, satisfy the equation N/M=odd integer, and M is an even integer, said horn gears being loaded symmetrically and evenly;

loading said second filament type on all unoccupied carriers on said horn gears; and operating said braiding apparatus to produce a braided device having a braid pattern, whereby said first filament type defines an integral axis symmetrical 1×1 sub-pattern producing a relatively stable axis symmetrical structure independent of the filaments of the second type and providing at least 75% of the rigidity of the braided device.

10. The method of claim 9, wherein said integral axis symmetric 1×1 sub-pattern provides 90% of the rigidity of said braided device.

11. The method of claim 9, wherein said braided device is an implantable intraluminal device.

12. The method of claim 9, wherein said braided device is a stent.

13. The method of claim 9, wherein said braided device is a stroke prevention device.

14. The method of claim 4 wherein said braid pattern is a single filament 1×1 braid pattern.

15. The method of claim 4 wherein said braid pattern is a double filament 1×1 braid pattern.

16. The method of claim 4 wherein said braid pattern is a 1×2 braid pattern.

* * * * *